US006646545B2

(12) United States Patent
Bligh

(10) Patent No.: US 6,646,545 B2
(45) Date of Patent: Nov. 11, 2003

(54) COLOR-CODED EVACUATION SIGNALING SYSTEM

(76) Inventor: Maurice Bligh, 11 South Avenue, Sittingbourne Kent (GB), ME10 4SR ( * ) Notice: Subject to any disclaimer, the term of this patent is extended or adjusted under 35 U.S.C. 154(b) by 0 days.

(21) Appl. No.: 09/988,833

(22) Filed: Nov. 20, 2001

(65) Prior Publication Data

US 2002/0057204 A1 May 16, 2002

(51) Int. Cl.[7] ..... G08B 5/00

(52) U.S. Cl. ..... 340/286.05; 340/293; 340/326; 340/332; 340/815.4

(58) Field of Search ..... 340/286.05, 286.11, 340/293, 326, 331, 332, 628, 691, 815.4; 362/227

(56) References Cited

U.S. PATENT DOCUMENTS

| | | | | | |
|---|---|---|---|---|---|
| 4,074,225 | A | * | 2/1978 | Vandeweghe | 340/329 |
| 4,347,499 | A | * | 8/1982 | Burkman, Sr. et al. | 340/286 R |
| 4,754,266 | A | * | 6/1988 | Shand et al. | 340/691 |
| 4,796,018 | A | * | 1/1989 | Nakanishi et al. | 340/691 |
| 5,654,690 | A | * | 8/1997 | Ishikawa et al. | 340/506 |
| 5,775,016 | A | * | 7/1998 | Chien | 40/544 |
| 5,815,068 | A | * | 9/1998 | Vadseth | 340/332 |
| 5,818,326 | A | * | 10/1998 | Winterble et al. | 340/286.05 |
| 5,977,872 | A | * | 11/1999 | Guertin | 340/515 |
| 6,025,773 | A | * | 2/2000 | Bresnan | 340/407.1 |
| 6,120,874 | A | * | 9/2000 | Shorten | 428/92 |
| 6,150,943 | A | * | 11/2000 | Lehman et al. | 340/628 |
| 6,249,221 | B1 | * | 6/2001 | Reed | 340/539 |
| 6,317,042 | B1 | * | 11/2001 | Engelhorn et al. | 340/539 |
| 6,472,994 | B1 | * | 10/2002 | Tator | 340/815.4 |
| 6,496,110 | B2 | * | 12/2002 | Peterson et al. | 340/522 |

FOREIGN PATENT DOCUMENTS

| | | | |
|---|---|---|---|
| BE | 1010798 | * | 2/1999 |
| DE | 10001744 | * | 7/2001 |
| EP | 0881616 | * | 12/1998 |
| GB | 1498483 | * | 1/1978 |
| JP | 4254888 | * | 10/1992 |
| JP | 10240173 | * | 9/1998 |
| JP | 2001188494 | * | 7/2001 |

* cited by examiner

*Primary Examiner*—Brent A. Swarthout

(57) ABSTRACT

A battery powered, illuminated, color-coded evacuation signalling system embodying symbols and text messages in any language or combination of languages, configured by LED's in a network of floor laid display units installed in land-based buildings or maritime structures. The system induces automatic dissemination of walking or crawling evacuees during an emergency, particularly in smoke, fog and low-light conditions, by guiding them away from deemed danger zones, then along assessed safe routes leading towards assessed safe designated exits. LEDs shine through transparent covered, narrow strip assembly units laid in the center of walkways. Red denotes predetermined and developing 'danger zones'. Green denotes safety 'go-routes'. Amber indicates system status. In-going firefighters may access a time-identified schematic picture relating to the spread of fire, temperatures and air quality, to evaluate what areas of a structure are safe or unsafe to enter.

10 Claims, 5 Drawing Sheets

COLOR-CODED EVACUATION SIGNALING SYSTEM

BACKGROUND OF THE INVENTION

The invention relates to a network or array of battery-powered, illuminated, color-coded symbols and text messages, in any required language or combination of languages, configured by LED's housed in a series of narrow strip assembly units laid flush in the center of floors in land-based buildings and maritime structures.

The system encourages automatic dissemination of evacuees during fire-drills and fire emergencies, particularly in a smoke fog and low light conditions following a mains-lighting failure. Walking or crawling evacuees are guided away from assessed danger zones, then via assessed safe routes leading to assessed safe designated exits. Provision is also made for in-going firefighters to access a schematic picture pertaining to the location, extent and nature of a fire, prior to entering a structure.

Fire is our greatest danger. An outbreak in office complexes, public libraries, hospitals, hotels, superstores, shopping malls, passenger liners, oil-rig platforms etc., often involves hundreds, sometimes thousands of people contained in a maze of boxes inside a box. They need to escape from the dangers of fire by negotiating routes which will lead them quickly towards their nearest and safest designated emergency exits.

For decades conventional battery-powered lights in ceilings, with printed or illuminated 'FIRE EXIT' signs on walls or above fire doors, have been provided to assist emergency egress. Yet in dense smoke rising to the ceiling, these signs are liable to become obscured and illegible, rendering them ineffective for their intended purpose.

A nightmarish scenario then presents itself. Disorientated evacuees, perhaps in semi-darkness and gasping for breath as air becomes smoke polluted and starved of oxygen, are nevertheless obliged to embark upon the time-consuming trial-and-error method of finding their own route to safety. Doors leading to no-exit storerooms, toilets and dead-end corridors are obstacles they have to overcome in a maze-type puzzle they must solve quickly, or possibly perish in the attempt.

In recent times concern has been voiced about the nature of fires and resulting fatalities. In any kind of emergency, too many people using too few exits has proven a perennial problem. Fire-drills and theory advocates preferably organized dissemination of evacuees towards their nearest available exits. In reality where panic-stricken evacuees have instinctively tended to congregate into 'follow the leader' surges or stampedes towards any exit, a pile-up of bodies has too often resulted in deaths from crushing at the doors of randomly chosen exits.

Arguably, more worrying is the increasing fatality statistics related to asphyxiation from inhalation of lethal toxic gases produced by burning plastics and other man-made combustible materials. It is said that asphyxiation from toxic smoke can occur in less than ten minutes, leaving little time for even the most calm and organized evacuees to determine which routes/exits are safe to attempt egress, and which are not.

Given that no evacuee can afford to waste a minute of whatever safe evacuation or precious survival time is available, getting 'lost' has undoubtedly been a major factor as the indirect cause of death in a fire situation. Sadly, many victims asphyxiated in un-burned sections of a building have been found within short distances of available safe exits, while others have expired apparently during expeditious excursions into the unknown, unaware that they were heading towards, rather than away from danger.

In addressing these problems, a number of inventions have utilized the concept of providing low/ground-level emergency lighting to augment overhead lighting. Various apparatus has predominantly employed white or near-white light-emitting chemicals and incandescent components incorporated in strip lighting running along walls and skirtings, illuminated wall-handles, illuminated carpet overlays and strip illumination in floors approaching fire exit doors.

When it was found that even low-powered white light diffuses in smoke at or near ground level—the unhelpful effect similar to that experienced by drivers using vehicle headlamps in fog—Gerald H. Gross (U.S. Pat. No. 5,130,909) introduced a floor lighting strip containing horizontally assembled, counterfacing, paired light emitting diodes with reflective prisms producing static, angled beams of light to guide evacuees.

However, none of the aforementioned inventions or existing overhead lighting and statutory 'FIRE EXIT' signs are capable of informing evacuees on route to designated fire exits, whether or not they are heading towards or away from danger.

It is a paradox that existing statutory signs (when legible) in an unpredictable fire situation, can direct evacuees unwittingly towards exits which themselves may be part of a danger zone to be otherwise sensibly avoided. Therefore, in my view, it is of paramount importance that evacuees be guided swiftly away from any predetermined or assessed developing danger zones as fire and smoke spreads, and then only along assessed safe routes leading towards assessed safe exits.

BRIEF SUMMARY OF THE INVENTION

Accordingly, the primary objective of this invention is assist walking or crawling evacuees who may find themselves engulfed in darkness and in a smoke fog—without prior knowledge as to where safe available designated exits are located in buildings or maritime structures—by guiding them calmly and swiftly via routes leading away from any predetermined or developing danger zones, and then towards the nearest and safest available designated exits.

Another objective is to induce automatic dissemination of evacuees during simulated emergencies or fire-drills, during flooding, earthquakes, bomb-scares and others types of non-fire emergencies.

Another objective is to provide firefighters with an update, time-identified schematic picture relating to the location, spread and nature of a fire prior them entering a structure.

This is achieved by employing a network array of color-coded, static or actively illuminated symbols and text messages displayed in any language or combination of languages, embodied in narrow strip assembly units laid flush in the center of corridors, passages and walkways on routes leading towards designated exits, or occasionally where deemed hazardous features (such as dead-end corridors) need to be defined.

The invention primarily utilizes the internationally recognized color-code as employed in traffic lights:—the color green for GO, and the color red for STOP or danger. Green defines all predetermined or updated advisable 'go-routes'. Red defines all predetermined, developing or updated advisable 'no-go areas/danger zones'.

On illuminated green go-routes, evacuees follow a series of distinctive green arrow symbols which appear to move forward in a wave-like motion, and in the direction in which they are pointing. At strategic stages the arrows are interspersed with static green colored text messages or 'comfort guides', for example, relating to distances towards assessed safe exits. These can be read 'on the trot' in the vertical mode, or horizontally at 'T' junctions or at a crossroads of corridors/walkways where green go-arrows may be found pointing in different directions when more than one designated exit is deemed safe and available for use. In this instance, emphasis is placed upon encouraging evacuees to use the nearest/safest route/exit; the first few visible green go-arrow symbols are seen to move more rapidly to attract their attention.

The color green, used widely in ophthalmic hospitals for its soothing visual properties and claimed calming effect, diffuses less than white light in smoke at or near ground level. The effect of any green light diffusion produced by the active arrow symbols appears as useful pulses or blocks of green light moving always in the advised go-route direction. Consequently, even for an appreciable small minority of color-blind evacuees, this movement of green light stands in contrast to static or flashing red colored no-go danger zone warnings to identify predetermined hazards such as dead-end corridors, or doors leading to no-exit basements etc, additionally those areas assessed as developing danger zones due to spreading fire and smoke.

In one example of a predetermined danger-zone; namely at the entrance to elevators, here floor units display a red colored flashing text message warning or advising evacuees:—'DONT USE—GO TO EXIT'. In other examples of predetermined danger zones, such as a main entrance to a structure with electrically operated revolving doors, or on the approach to dead-end corridors, here floor units display red colored flashing 'X' warning symbols with inverted triangle symbols and/or suitable text messages to emphasis potential dangers.

As and when fire and smoke intensifies, resulting in developing danger zones, these zones are added to those predetermined as dangerous or nogo routes. Any designated exits or escape routes detected to have fallen within a fire/smoke danger zone triggers automatic re-designation of green go and red no-go routes throughout the system. Green go-routes leading towards danger zones are cancelled, and red no-go danger zones established in their place. Green go-arrows can be reversed, likewise advisory text messages and symbols initiated to effectively re-route evacuees away from danger and towards alternative nearest/safest exits.

In normal or standby mode, the color amber is also employed, sparingly, to indicate status for inspection/maintenance purposes.

DETAILED DESCRIPTION OF THE INVENTION

Figure 1:
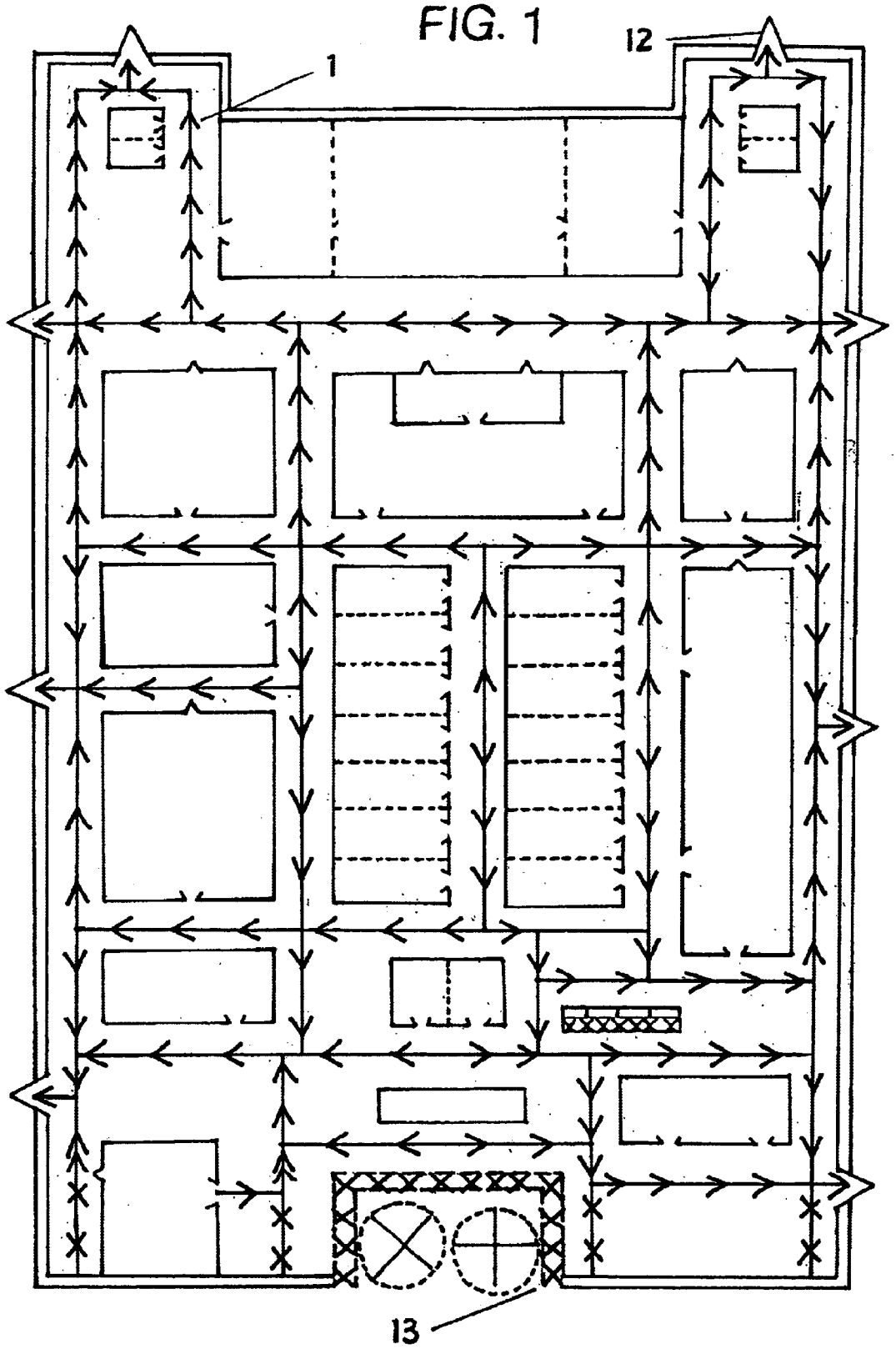
FIG. 1, shows a plan view of a simulated structure such as an office complex in which assessed safe routes are indicated by arrow symbols configured by illuminated LED's 1. They point by various routes towards assessed safe designated exits 12. Illuminated LED's 2 configure warning 'X' symbols 13 indicating an area or feature designated as a predetermined danger zone.
Figure 2:
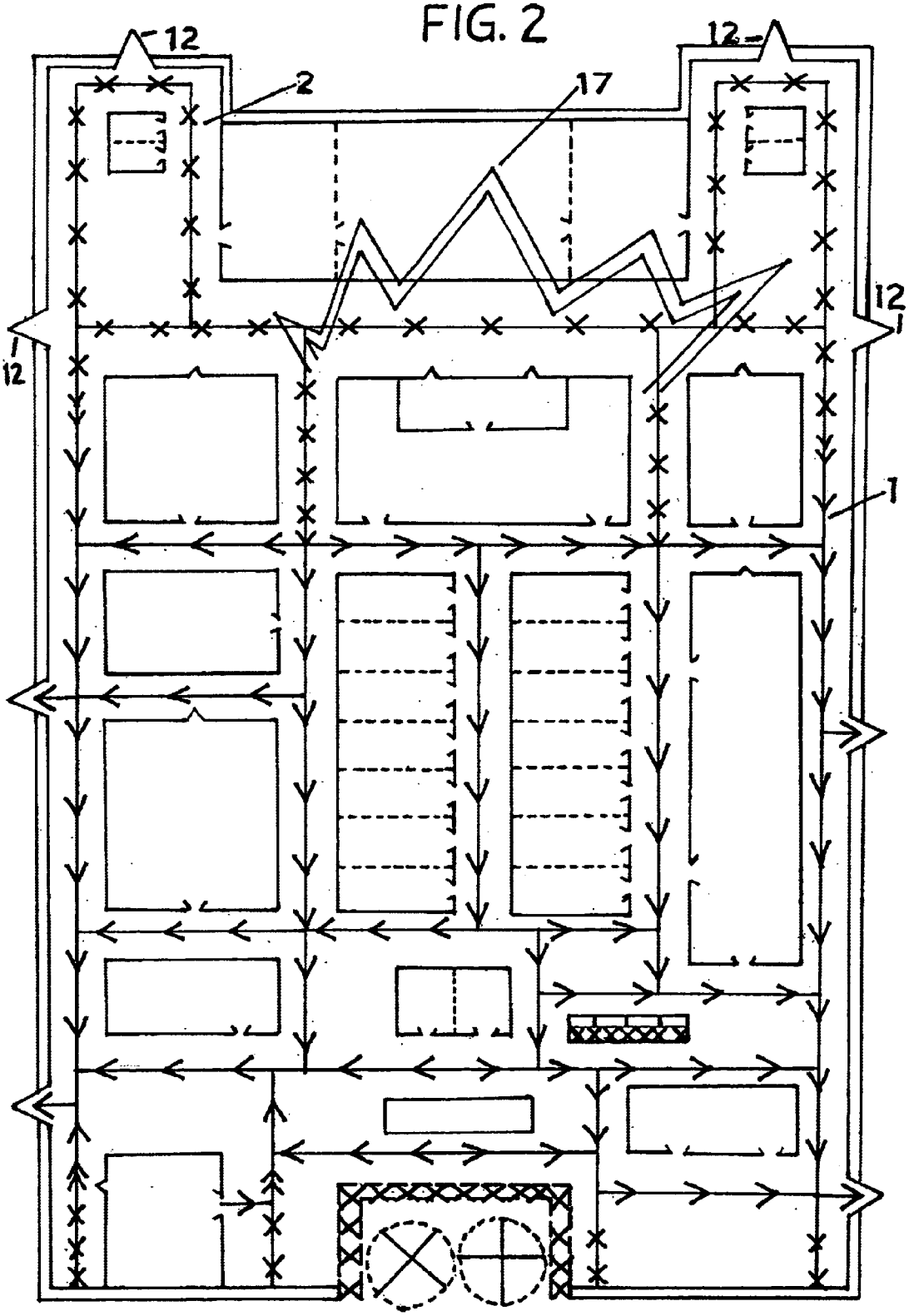
FIG. 2, shows a plan view of a simulated structure as shown in FIG. 1, but wherein the signalling system has been activated on the detected outbreak of fire and smoke 17. Assessed safe or 'go' routes indicated by illuminated arrows configured by LED's 1, now point away from illuminated 'X' symbols configured by LED's 2, to indicate a developing fire/smoke danger zone in the vicinity of exits 12.
Figure 3:
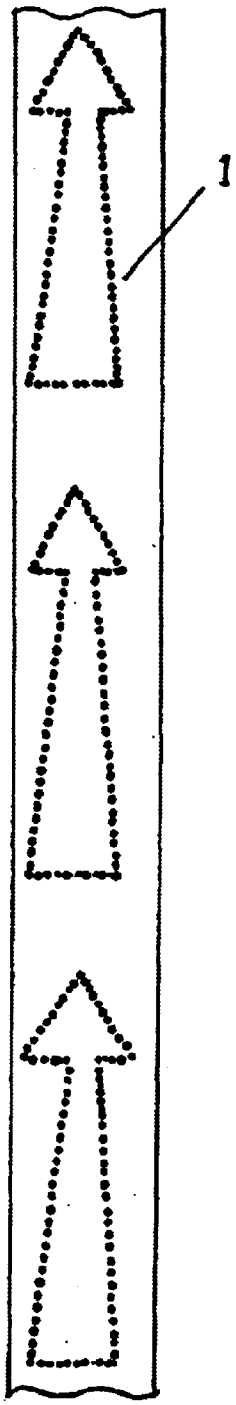
FIG. 3, shows a plan view of part of the signalling system's network of floor laid units where illuminated LED's 1 are configuring green colored arrow symbols as if moving in a wave-form motion while in the pointing direction.
Figure 4:
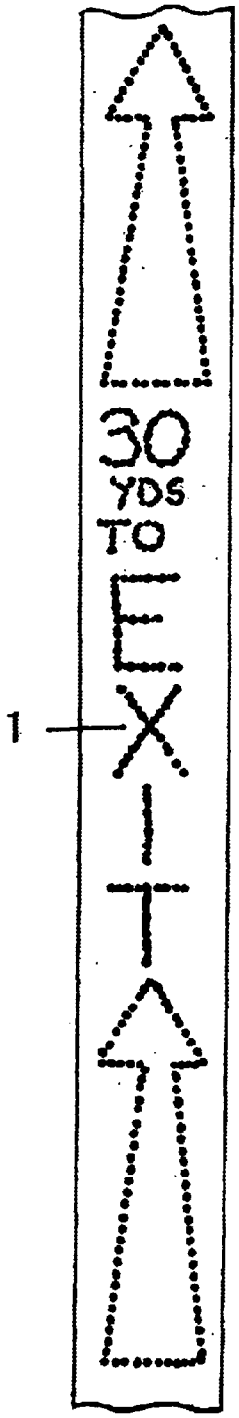
FIG. 4, shows a plan view of part of the signalling system's network of floor laid units where illuminated LED's 1 configure green colored arrow symbols indispersed with a green colored text message relating to a predetermined distance from an assessed safe designated exit.
Figure 5:
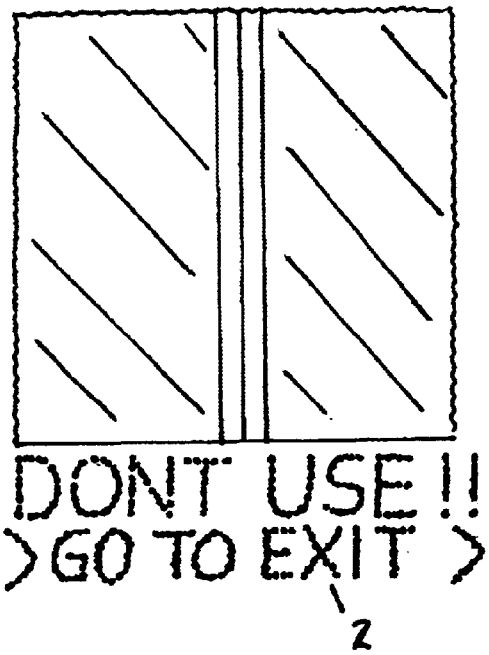
FIG. 5, shows an approach view of an elevator where a floor laid unit displays illuminated LED's 2 to configure a flashing red colored warning text message with arrow-head symbols to indicate exit direction, and that the elevator is designated a danger.
Figure 6:
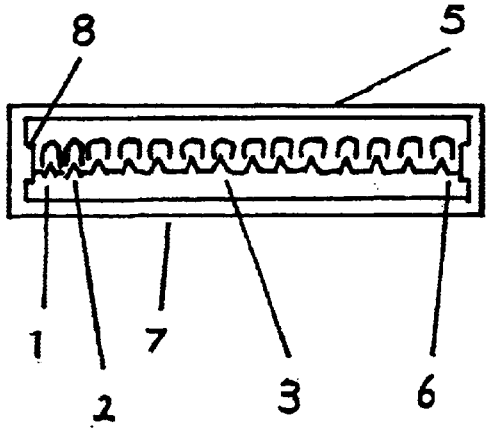
FIG. 6, shows a cross-section view of a signalling system unit with example LEDs 1, LEDs 2 and LED 3 mounted on a printed circuit board 6, supported by bracket 8, housed in a shallow container 7, protected by transparent cover 5.
Figure 7:
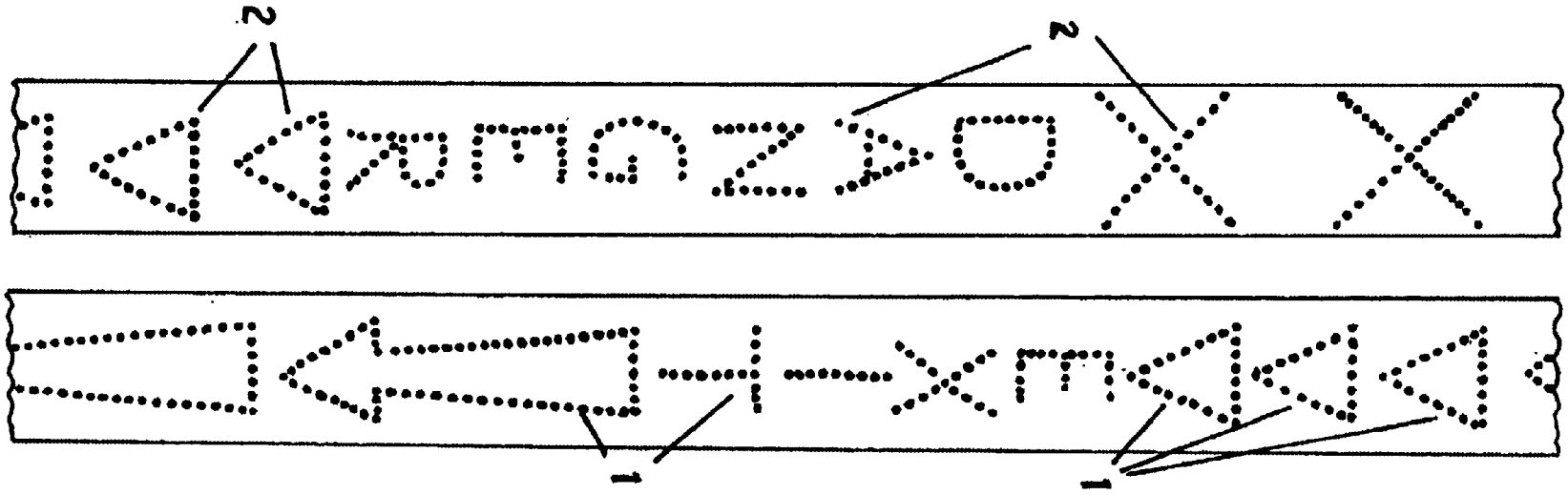
FIG. 7, shows a plan view of part of the signalling system's network of floor laid units (in two continued sections) where an assessed danger zone illuminated by red colored LED's 2, merges with an assessed safety zone illuminated by green colored LED's 1.
Figure 8:
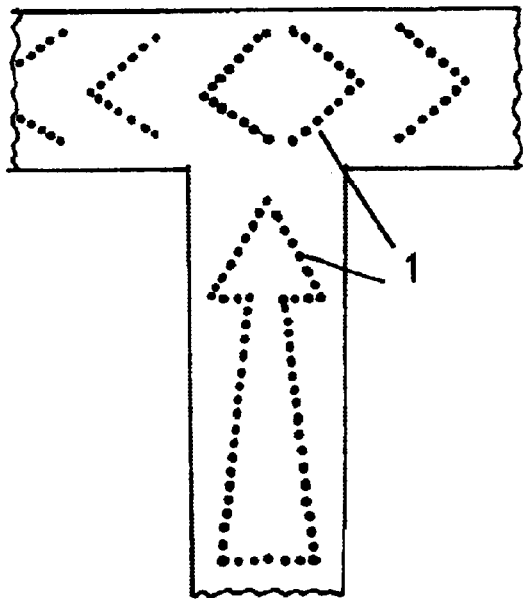
FIG. 8, shows a plan view of part of the signalling system's network of floor laid units where two walkways intersect at a 'T' junction. Illuminated green colored LED's 1 configure arrow-head symbols as if moving in the pointing directions to indicate two assessed safe routes leading towards assessed safe designated exits.
Figure 9:
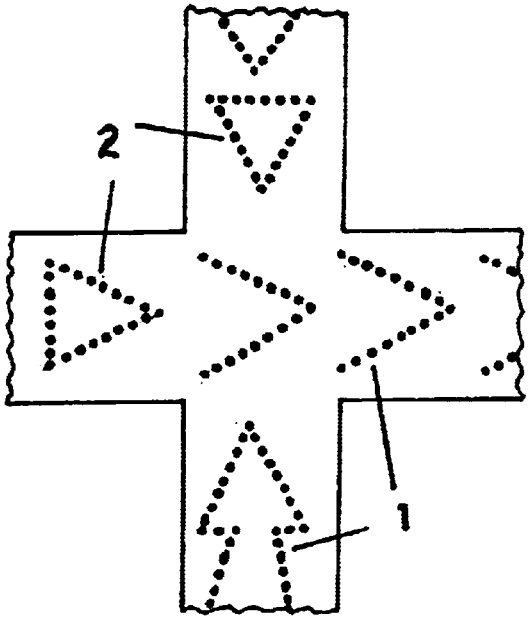
FIG. 9, shows a plan view of part of the signalling system's network of floor laid units where four walkways intersect at a 'rossroads'. Illuminated red colored LED's 2 indicate two routes as assessed danger zones, while illuminated green colored LED's 1 indicate a right-hand turn towards an assessed safe route leading towards an assessed safe designated exit.
Figure 10:
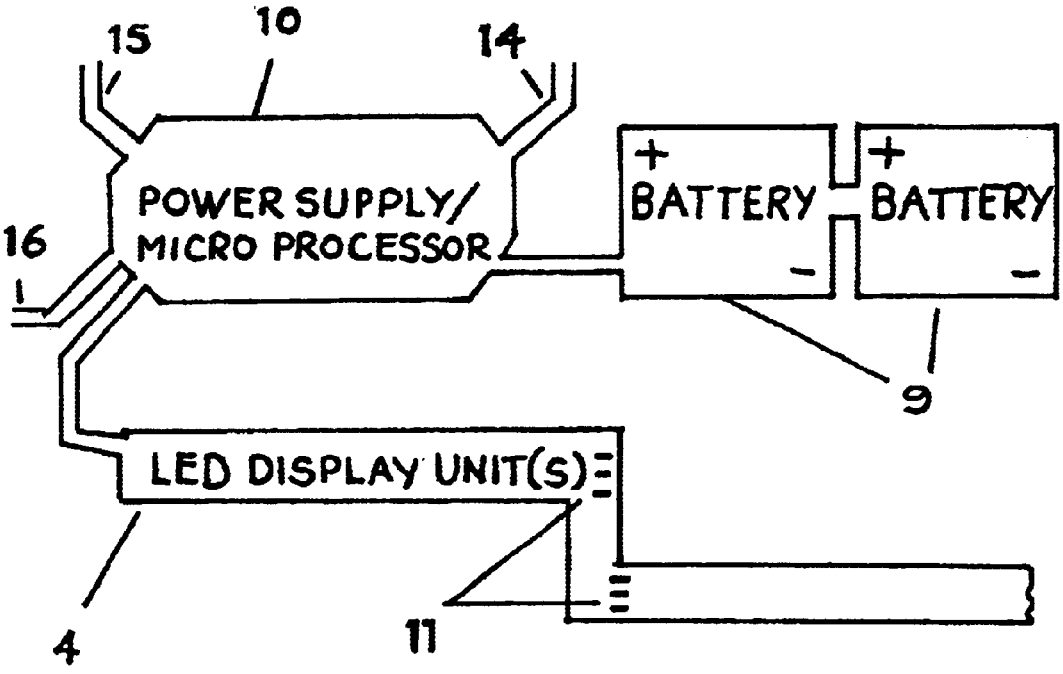
FIG. 10, shows a schematic diagram of the signalling system. Battery (or batteries) 9, connect to power-supply micro processor 10, connected by multi-pin devices and circuitry 11, to system floor laid unit(s) 4. Input connection 14 receives mains power supply. Input connection 15 receives data from a structure's network of smoke/heat/CO2/CO or related detectors. Output connection 16 relays processed data for electronic downloading by firefighters.

The preferred embodiment of the invention consists of a number of variable length assembly units necessary to accommodate the multifarious dimensions and layout of buildings and maritime structures. These units are laid flush in the center of uncovered or tiled/carpeted floors, walkways, corridors etc., and are connected in series or railway line fashion. They constitute a network or array of green/red/amber colored LEDs (light-emitting diodes) configured to display symbols and text messages when illuminated in an emergency, or during practice evacuation/fire drill.

An assembly unit contains a variable number of LEDs sufficient to fulfil the various requirements of its function.

The LEDs are of sufficient luminosity (candela) to achieve a satisfactory visible display in variable natural/artificial light conditions and/or in a survivable smoke fog during mains lighting failure.

A unit of required length comprises of LEDs assembled vertically on a printed circuit board beneath which are other necessary electronic components and connectors hidden from view. The printed circuit board is supported in a shallow, electrically isolated container protected by a waterproof transparent cover allowing illuminated LEDs to shine through.

All units are connected by interfacing multi-pin devices, and a separate back-up circuitry is provided for re-routing power supply in the event of individual units being destroyed while in series connection.

The network assembly receives power and coded instructions from a central power-supply micro processor which commands all units to begin and continue displaying symbols and text in any one or combination of the following modes:—static, flashing, traversing or multi wave-form motion, bi-directional or omni-directional.

The power supply processor is connected to a statutory fire-alarm system and is activated simultaneously in an emergency, or otherwise. In the event of mains-lighting failure, the power-supply processor automatically receives DC power from an independent battery or batteries rated with sufficient voltage and current to sustain operational functions for a period of time sufficient to comply with national regulations.

On activation, the power supply processor immediately draws upon available data provided by a network of smoke/heat/$CO_2$/CO or other available relative detectors. This information is time-based and stored in memory prior to the transmission of coded signals to all floor display units to begin and continue illumination. The incoming data is processed and compared with pre-programmed 'safety parameters' relating to the effects of fire and smoke, specifically in regards to deemed survivable or non-survivable temperatures and air quality. This determines what areas of a structure are to be designated as developing danger zones, and consequently what areas require instantly updating or re-routing as escape go-routes/exits.

Thus while continuing to monitor even rapidly spreading fire and smoke, the power supply processor keeps abreast as to where green colored go-routes and red colored no-go zones are displayed. For instance, a sudden outbreak of fire in a previously deemed survivable, if smoke filled 'go-route' corridor leading towards one or more designated exits, would instantly trigger red colored danger zone warnings, such as flashing 'X' symbols and inverted triangle symbols with strategically located 'DANGER' text message within the immediate effected vicinity and beyond to an assessed point of safety before merging with green go-arrow symbols and/or green go arrow-head symbols displayed, as always, pointing away from detected danger.

To perform these functions, the power supply processor's electronic memory is stored on installation with a circuit diagram or alpha-numeric schematic containing the following information for cross-referencing:

1) where a structure's designated exits are located.
2) where a structure's network of smoke/heat/$CO_2$/CO or related detectors are located.
3) where the signalling system's own units are located in relation to exits and detectors.
4) where predetermined no-go areas on route to exits are to be displayed in red colored symbols and warning text mode.

Accordingly, the combined fixed-point references as detailed allow the power supply processor to continuously update and determine as to where green colored go-route symbols and text are to be displayed, likewise red colored warning symbols and text.

The fixed-point references also allows the system to 'map' an outbreak or spread of a fire, and time record the events for further analysis. This feature affords in-going firefighters with an opportunity to access an update status report or schematic picture prior to, or on arrival at the scene of a fire, via external communication links. The varying degrees of danger associated with current ambient temperatures and air quality may then be evaluated before deciding what areas of a structure may be safe or unsafe to enter for the purpose of containing and extinguishing fire.

In normal or standby mode the power supply processor draws upon mains power supply to sustain system integrity and periodic charging of a battery or batteries for providing a sustainable low voltage emergency DC power-supply, usually 12 or 24 volt rating.

The network of signalling units are also constantly monitored to detect system faults. For visual maintenance purposes, each unit contains an amber colored LED to indicate unit status. A steady illuminated amber light indicates OK mode. A slow flashing amber light indicates a unit fault or failure. A rapid flashing amber light in all units indicates multiple unit/system fault or imminent failure (such as low battery-power supply).

What I claim as my invention is:

1. A color-coded evacuation signaling system wherein temperature and air-quality data is received from a network of smoke, heat, CO2, CO, toxic gas, combustible gas or related hazardous-element detectors, then processed by a power supply processor, being also a programmable interactive micro processing unit which accesses pre-programmed schematic data relative to the location of designated exits, and which evaluates said temperature and air-quality and schematic data for the purpose of illuminating direction-indicating symbols and text messages, displayed in any required language or combination of required languages, configured by light emitting diodes (LED's) contained in transparent-covered assembly units, connected in series to form a continuous strip or array laid flush in the center of uncovered or covered floors, corridors, walkways within land-based buildings and maritime structures, to guide walking or crawling evacuees who may find themselves in low-light conditions or in a smoke fog during a fire or general emergency, initially away from predetermined and assessed developing danger zones, represented by the color red, and then via assessed safe routes, represented by the color green, leading to their nearest and safest assessed designated exits, the color of respective illuminated assembly units being variable based on the location of danger zones.

2. A color-coded evacuation signalling system, as claimed in claim 1, wherein illuminated red colored LEDs configure 'X' symbols, inverted triangle warning symbols and danger warning text messages displayed in flashing or static mode, to indicate specific features, areas, routes and designated exits within a structure assessed as unsuitable for use during the process of evacuation.

3. A color-coded evacuation signalling system, as claimed in either claim 1 or claim 2, wherein illuminated green coloured LEDs configure elongated arrow symbols, arrow-head symbols and advisory text messages displayed in forward or reversed traversing mode, bi-directionally, omni-directionally, to indicate specific safe assessed routes leading to safe assessed designated exits during the process of evacuation.

4. A color-coded evacuation signalling system, as claimed in either claim 1 or claim 2 wherein amber coloured LEDs are illuminated during normal or standby mode to indicate system status for the attention of maintenance personnel, and wherein a secondary or back-up electrical circuit is incorporated for the purpose of re-routing power and coded instructions to individual LED display units within the network of system units, in the event that one or more of the said units are destroyed by fire, or by other means, during an emergency.

5. A color-coded evacuation signalling system as claimed in either claim 1 or claim 2, wherein the system may be activated in a simulated emergency such as a routine fire-drill, or during a bomb-scare or other non-fire emergencies, for the purpose of encouraging automatic dissemination of evacuees from wherever they are located in proximity to escape walkways, by guiding them via predetermined shortest distance routes leading to their nearest respective designated exits.

6. A color-coded evacuation signalling system wherein a power supply processor being also a programmable, interactive micro processing unit, contains pre-programmed schematic and alpha-numeric data relating to the location of designated exits within land-based buildings and maritime structures; also the location of predetermined hazards or areas deemed to be danger zones; also the location of a structure's network of detectors, multi-functional or otherwise, for detecting smoke, heat, $Co_2$, CO, combustible gas, toxic gas, or related hazardous elements; also the location of the signalling system's LED display units for the purpose of mapping and holding in memory pre-determined distances between said exits, detectors and LED display units for cross-referencing and correlating the whereabouts of detected fire and smoke; also for time-identifying an outbreak and progress of fire and smoke; also for tracking the spread of fire and smoke; also for recording detected temperatures and air quality influenced by fire and smoke; also for the purpose of assessing and re-assessing what areas of a structure are consequently to be deemed as red-colored danger zones or green-colored safety zones, and for the purpose of instructing the system's center-floor laid LED display units to illuminate and define, or re-define, assessed danger routes/exits, and assessed safety routes/exits, with advisory text messages relating to distances, for the routing and re-routing of evacuees during a fire or gas-leak emergency.

7. A color-coded evacuation signalling system as claimed in claim 6, wherein a programmable micro processor unit stores pre-programmed data relating to a reference table of safety parameters defining to what degree detected temperatures and air quality is humanly survivable, or un-survivable, for the purpose of adapting the system's LED display units to define or re-define assessed dangers and assessed safe routes/exits during a fire or gas-leak emergency.

8. A color-coded evacuation signalling system, as claimed in either claim 6 or claim 7, wherein a programmable micro processing unit reacts to input data received from a structure's network of detectors for the purpose of registering temperatures and air-quality during normal or standby mode, and wherein the said power supply processor also reacts to, and is automatically activated by input data received from a structure's emergency alarm system, for the purpose of illuminating and adapting the color-coded evacuation signalling system's LED display units to indicate routes and designated exits deemed dangerous or safe for use by evacuees during an emergency.

9. A color-coded evacuation signalling system, as claimed in either claim 6 or claim 7, wherein a network display of illuminated symbols and text messages indicate which features, areas and routes of a structure are predetermined as dangerous for use by evacuees during an emergency, including elevators, electrically-operated revolving or sliding doors, stairs and escalators leading up or down to no-exit areas, dead-end corridors, no-exit toilets, no-exit store rooms, no-exit basements, no-exit offices, no-exit apartments or dwelling accommodation, no-exit lofts or areas of a structure wherein evacuees are denied free access to routes leading to assessed safe designated exits.

10. A color-coded evacuation signalling system, as claimed in either claim 6 or claim 7, wherein a programmable micro processor unit stores data relative to an update status report or schematic picture of registered temperatures/air quality within a structure, accessible for electronic downloading via external communication links, for the purpose of assisting in-going firefighters to determine what areas of a structure are safe or unsafe to enter, prior to or on arrival at the scene of a fire or gas-leak emergency.

* * * * *